US005369081A

United States Patent [19]

Evans et al.

[11] Patent Number: 5,369,081

[45] Date of Patent: Nov. 29, 1994

[54] NITROPYRAZOLYLAZOANILINE DYE-DONOR ELEMENT FOR THERMAL DYE TRANSFER

[75] Inventors: Steven Evans, Rochester, N.Y.; Max A. Weaver, Kingsport, Tenn.; Helmut Weber, Webster, N.Y.

[73] Assignee: Eastman Kodak Company, Rochester, N.Y.

[21] Appl. No.: 169,834

[22] Filed: Dec. 16, 1993

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 913, 428/914; 503/227

[56] References Cited

U.S. PATENT DOCUMENTS 4,764,178 8/1988 Gregory et al. ..... 8/471

5,079,213 1/1992 Chapman et al. ..... 503/227

*Primary Examiner*—B. Hamilton Hess

*Attorney, Agent, or Firm*—Harold E. Cole

[57] ABSTRACT

A dye donor element for thermal dye transfer comprising a support having thereon a dye in a polymeric binder, the dye being a 4-nitro-pyrazol-5-yl-azoaniline magenta dye, such as one having the formula:

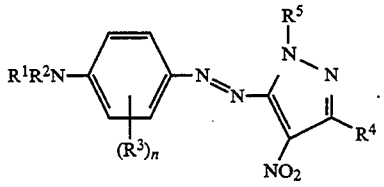

9 Claims, No Drawings

NITROPYRAZOLYLAZOANILINE DYE-DONOR ELEMENT FOR THERMAL DYE TRANSFER

This invention relates to dye-donor elements used in thermal dye transfer, and more particularly to the use of 4-nitro-pyrazol-5-yl-azoaniline magenta dyes.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide dyes which have bright hue, good solubility in coating solvents, good transfer efficiency and good light stability.

U.S. Pat. No. 4,764,178 broadly describes heterocyclic-azoaniline dyes of the formula:

A–N=N–E wherein A is the "residue of a diazotizable heteroaromatic amine" including aminopyrazoles among several others. While nitro is broadly described as a substituent for the group of heterocycles "A", the only substituent specifically disclosed in the 4-position of the pyrazole ring is cyano (col. 2, lines 27–31 and 56; col. 4 lines 48–56; and Table 1, Dyes 2–13). U.S. Pat. No. 5,079,213 describes specific 4-cyano-pyrazol-5-yl-azoaniline dyes for use in thermal dye transfer imaging. While the dyes of these references can have good hue, solubility and transfer efficiency, they suffer from poor light stability. It is an object of this invention to provide pyrazolylazoaniline dyes for thermal dye transfer which have improved light stability.

These and other objects are achieved in accordance with this invention which comprises a dye-donor element for thermal dye transfer comprising a support having thereon a dye dispersed in a polymeric binder, the dye being a 4-nitro-pyrazol-5-yl-azoaniline magenta dye. In a preferred embodiment, the dye has the formula:

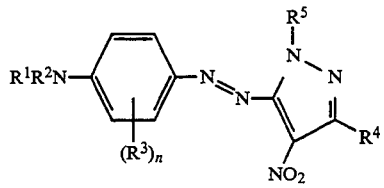

wherein: $R^1$ may be alkyl of 1 to about 12 carbon atoms, aryl of from 6 to about 10 carbon atoms, cycloalkyl of about 5 to about 7 carbon atoms or allyl; or such alkyl, aryl, cycloalkyl and allyl groups substituted with one or more groups chosen from hydroxy, acyloxy, alkoxy, aryloxy, alkylthio, arylthio, alkylsulfonyl, arylsulfonyl, thiocyano, cyano, nitro, halogen, alkoxycarbonyl, aryloxycarbonyl, acetyl, aroyl, alkylaminocarbonyl, arylaminocarbonyl, alkylaminocarbonyloxy, arylaminocarbonyloxy, acylamino, amino, alkylamino, arylamino, carboxy, trihalomethyl, alkyl, aryl, hetaryl, alkylureido, arylureido, succinimido, phthalimido and the like;

$R^2$ may be H or R1;

$R^1$ and $R^2$ may be joined together to form a 5- or 6-membered ring such as morpholine, piperidine or pyrrolidine;

either or both of $R^1$ and $R^2$ may be joined together with one of $R^3$ to form a 5- or 6-membered ring such as tetrahydroquinoline or julolidine;

$R^3$ may be H, acyloxy, alkoxy, aryloxy, alkylthio, arylthio, alkylsulfonyl, arylsulfonyl, alkylaminosulfonyl, arylaminosulfonyl, alkylsulfonylamino, arylsulfonylamino, thiocyano, cyano, halogen, alkoxycarbonyl, aryloxycarbonyl, acetyl, aroyl, alkylaminocarbonyl, arylaminocarbonyl, alkylaminocarbonyloxy, arylaminocarbonyloxy, acylamino, amino, alkylamino, arylamino, trihalomethyl, alkyl, aryl, hetaryl, alkylureido, arylureido, succinimido or phthalimido;

any two adjacent $R^3$'s may be combined to form a 5- or 6-membered carbo- or heterocyclic saturated or aromatic ring such as naphthalene, benzoxazole or quinoline;

n represents an integer from 1–4;

$R^4$ is the same as R2; and $R^5$ is $R^1$, acetyl, aroyl, alkylsulfonyl, arylsulfonyl or substituted or unsubstituted vinyl.

The above 4-nitro-pyrazol-5-yl-azoaniline magenta dyes have surprisingly superior light stability relative to the pyrazol-5-yl-azoaniline dyes previously described for use in thermal dye transfer imaging. The key feature is the presence of the nitro group in the 4-position of the pyrazole moiety. These dyes may be used alone or in combination with other dyes.

The light stability advantage of the magenta dyes employed in the invention is exhibited both in monochrome and mixed color images such as red (magenta +yellow). For example, good results are achieved when the magenta dyes employed in the invention are used with the following yellow dyes A or B.

A

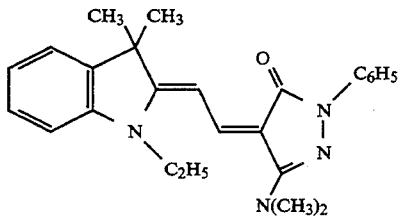

see U.S. Pat. No. 4,743,582

-continued

B

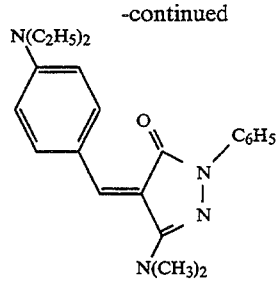

see U.S. Pat. No. 4,946,825

The synthesis of the dyes used in the invention is described in U.S. Pat. Nos. 3,639,384 and 4,650,861.

In a preferred embodiment of the invention, $R^1$ and $R^2$ are each ethyl or propyl, $R^3$ is 3-$NHCOCH_3$, $R^4$ is t-butyl or methyl, and $R^5$ is methyl, phenyl or $CH_2COCH_3$.

Specific dyes useful in the invention include the following:

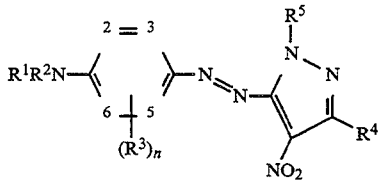

| DYE | $R^1$ | $R^2$ | $R^3$ | $R^4$ | $R^5$ | 1-max* |
|---|---|---|---|---|---|---|
| 1 | $C_2H_5$ | $C_2H_5$ | 3-$NHCOCH_3$ | t-$C_4H_9$ | $CH_3$ | 512 |
| 2 | $C_2H_5$ | $C_2H_5$ | 3-$NHCOCH_3$ | t-$C_4H_9$ | $CH_2COCH_3$ | 528 |
| 3 | $C_2H_5$ | $C_2H_5$ | 3-$NHCOCH_3$ | $CH_3$ | $C_6H_5$ | 522 |
| 4 | $C_3H_7$ | $C_3H_7$ | 3-$NHCOCH_3$ | $CH_3$ | $CH_3$ | 522 |
| 5 | 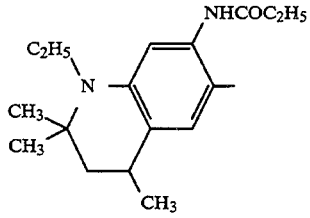 | | | t-$C_4H_9$ | $CH_3$ | 527 |
| 6 | $C_2H_5$ | $C_2H_5$ | 3-$CH_3$ | t-$C_4H_9$ | $CH_3$ | 493 |
| 7 | $C_2H_5$ | $C_2H_5$ | 3-$NHCOCH_3$ | $CH_3$ | $CH_3$ | 521 |
| 8 | $C_2H_5$ | $C_2H_5$ | 2-$OCH_3$ 5-$NHCOCH_3$ | $CH_3$ | $CH_3$ | 551 |
| 9 | $C_2H_5$ | $C_2H_5$ | 2-$OCH_3$ 5-$NHCOCH_3$ | t-$C_4H_9$ | $CH_3$ | 522 |
| 10 | 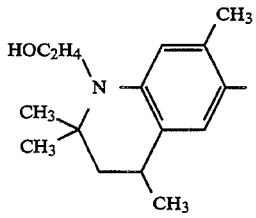 | | | $CH_3$ | H | 470 |
| 11 | 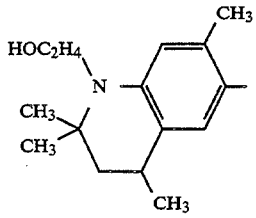 | | | $CH_3$ | $CH_3$ | 509 |

-continued

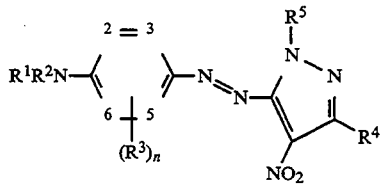

| DYE | $R^1$ | $R^2$ | $R^3$ | $R^4$ | $R^5$ | 1-max* |
|---|---|---|---|---|---|---|
| 12 | 2-$C_6H_{13}$ | H | 2-$OCH_3$ 5-$NHCOCH_3$ | $CH_3$ | $CH_3$ | 538 |
| 13 | s-$C_4H_9$ | H | 2-$CH_3$ 5-$NHCOCH_3$ | $CH_3$ | $CH_3$ | 517 |
| 14 | $C_2H_5$ | $C_2H_5$ | 3-$NHCOCH_3$ | t-$C_4H_9$ | $CH_2C_6H_5$ | 518 |
| 15 | $C_2H_5$ | $C_2H_5$ | 3-$NHCOCH_3$ | t-$C_4H_9$ | $C_3H_5$ (allyl) | 515 |
| 16 | $C_2H_5$ | $C_2H_5$ | 3-$NHCOCH_3$ | t-$C_4H_9$ | 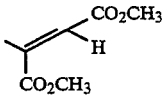 | 543 |
| A** | $C_2H_5$ | $C_2H_5$ | 3-$NHCOCH_3$ | $CH_3$ | H | 530 |
| B** | $C_2H_5$ | $C_2H_5$ | 3-$NHCOCH_3$ | t-$C_4H_9$ | H | 519 |

*measured in acetone solution
**Comparisons

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye in the dye-donor element of the invention is dispersed in a polymeric binder such as a cellulose derivatives, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; poly(styrene-coacrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 2 to about 30 μm. It may also be coated with a subbing layer, if desired, such as those materials described in U.S. Pat. Nos. 4,695,288 and 4,737,486.

The reverse side of the dye-donor element may be coated with a slipping layer to prevent the printing head from sticking to the dye-donor element. Such a slipping layer would comprise a lubricating material such as a surface-active agent, a liquid lubricant, a solid lubricant or mixtures thereof, with or without a polymeric binder. Preferred lubricating materials include oils or semicrystalline organic solids that melt below 100° C. such as poly(vinyl stearate), beeswax, perfluorinated alkyl ester polyethers, polycaprolactone, silicone oil, poly(tetrafluoroethylene), carbowax, poly(ethylene glycols), or any of those materials disclosed in U.S. Pat. Nos. 4,717,711, 4,717,712, 4,737,485, 4,738,950, and 4,829,050. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.001 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly(vinyl chloride), poly(styrene-coacrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,6980651, 4,695,287, 4,701,439, 4,757,046, 4,743,582, 4,769,360, and 4,753,922; the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and a magenta dye as described above, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-A040MCSOO1), a TDK Thermal Head F415 HH7-1089 or a Rohm Thermal Head KE 2008-F3.

A thermal dye transfer assemblage of the invention comprises:

(a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

Magenta dye-donor elements were prepared by coating the following layers in the order recited on a 6 μm poly(ethylene terephthalate) support:

1) subbing layer of DuPont Tyzor TBT ® titanium tetra-n-butoxide (0.16 g/m$^2$) coated from n-butyl alcohol, and 2) dye layer containing the magenta dye identified below and illustrated above (0.75 mmoles/m$^2$, and Fluorad FC-431 ®dispersing agent (3M Company) (0.01 g/m$^2$) in a cellulose acetate propionate (2.5% acetyl, 48% propionyl) binder (weight equal to 1.1X that of the dye), coated from a cyclopentanone, toluene, and methanol solvent mixture (5:66.5:28.5).

On the back side of the donor was coated a subbing layer 1) as above, and a slipping layer of Emralon 329 ® dry film poly(tetrafluoroethylene) lubricant (Acheson Colloids) (0.54 g/m$^2$) coated from a toluene, n-propyl acetate, 2-propanol and 1-butanol solvent mixture.

A dye-receiving element was prepared by coating on a 175 μm poly(ethylene terephthalate) support:

(1) a dye-receiving layer of Makroion ® 5700 bisphenol A polycarbonate (Bayer AG) (1.614 g/m$^2$), a random copolymer of 4,4'-isopropylidene-bisphenol-co-2,2'-oxydiethanol poylcarbonate (50:50) (1,614 g/m$^2$), dibutyl phthalate (0.323 g/m$^2$), diphenyl phthalate (0.323 g/m$^2$) and FC431 ®fluorosurfactant (3M Corporation) (0.011 g/m$^2$) coated from dichloromethane; and (2) an overcoat layer of a linear condensation copolycarbonate of bisphenol-A (50 mole %), diethylene glycol (49 mole %), and 2,500 MW polydimethylsiloxane block units (1 mole %) (11 g/m$^2$), Fluorad FC431 ® (0.02 g/m$^2$) and Dow Corning 510 Silicone Fluid (0.01 g/m$^2$) coated from dichloromethane.

Eleven-step sensitometric thermal dye transfer images were prepared from the above dye-donor elements. The dye side of the dye-donor element strip approximately 10 cm×15 cm in area was placed in contact with the dye image-receiving layer of the dye-receiver element of the same area. The assemblage was clamped to a stepper-motor driven 60 nun diameter rubber roller and a TDK Thermal Head (No. 810625) (thermostatted at 31° C.) was pressed with a force of 24.4 Newtons against the dye-donor element side of the assemblage pushing it against the rubber roller.

The imaging electronics were activated causing the donor/receiver assemblage to be drawn between the printing head and roller at 11.1 mm/sec. Coincidentally, the resistive elements in the thermal print head were pulsed (128 msec/pulse) at 129 msec intervals during a 16.9 msec /dot printing cycle. A stepped image density was generated by incrementally increasing the number of pulses/dot from a minimum of 0 to a maximum of 127 pulses/dot. The voltage supplied to the thermal head was approximately 10.25 v resulting in an instantaneous peak power of 0.214 watts/dot and a maximum total energy of 3.48 mJ/dot.

After printing, the dye-donor element was separated from the imaged receiving element and the appropriate (green) Status A reflection density of each of the eleven steps in the stepped-image was measured with an X-Rite Model 418 densitometer. The reflection density at the highest power is listed in the Table. The stepped images were then subjected to accelerated light fading conditions (1 week, 50 kLux high intensity daylight) and the Status A green reflection density of each step was remeasured and the percent dye loss from an initial density near 1.0 was calculated. The results are also listed in the Table.

Additionally, red eleven-step sensitometric thermal dye transfer images were prepared as above by sequential transfer in register from the above magenta dye-donor elements and a yellow dye-donor element (yellow patch of Eastmail Kodak R3000 Thermal Print Ribbon) containing the yellow dye A described above. The Status A Green (corresponding to magenta dye)

and Blue (corresponding to yellow dye) reflection densities were measured as above before and after light fading (1 week, 50 kLux high intensity daylight) of a step with initial density of approximately 1.0 in each color and the percent loss for each dye calculated as follows:

TABLE

| Dye | Status A Green Dmax | % Light Fade Monochrome* | % Light Fade Red (magenta + yellow) % green* | % blue** |
|---|---|---|---|---|
| 1 | 2.4 | 16 | 32 | 37 |
| 2 | 2.5 | 19 | 32 | 39 |
| 3 | 2.5 | 14 | 19 | 28 |
| 4 | 2.7 | 10 | 25 | 28 |
| 5 | 2.0 | 26 | 35 | 50 |
| 6 | 1.6*** | 25 | not measured | |
| 9 | 2.5 | 28 | 35 | 57 |
| 12 | 2.4 | 19 | 22 | 50 |
| 13 | 2.4 | 10 | 15 | 27 |
| 16 | 1.6 | 18 | 28 | 58 |
| Control 1 | 2.6 | 65 | 75 | 52 |
| Control 2 | 2.7 | 67 | 69 | 68 |
| Control 3 | 1.1 | 80 | 68 | 72 |
| Comparison A | 2.2 | 93 | 84 | 73 |
| Comparison B | 1.8 | 84 | 76 | 53 |

*Percent loss in Status A Green density (corresponds to magenta dye loss) from initial density of approximately 1.0. Conditions: 50 KLux High Intensity Daylight, 7 days

**Percent loss in Status A Blue density (corresponds to yellow dye loss) from initial density of approximately 1.0. Conditions: 50 KLux High Intensity Daylight, 7 days

***Densities appear low because these dyes are very orange and thus the wavelength of maximum absorption of the dye does not correspond well with the Status A green filter.

Control dye structures:

Control 1

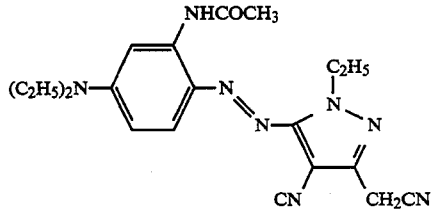

Dye 9 from U.S. Pat. No. 4,674,178

Control 2

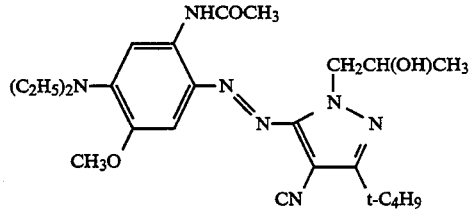

Dye 1 from U.S. Pat. No. 5,079,213

Control 3

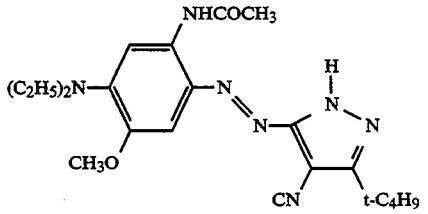

Dye Intermediate from
U.S. Pat. No. 5,079,213 (Col. 7, Line 36)

As can be seen from the results in the Table, the dyes employed in the invention are particularly useful for thermal dye transfer imaging applications. The dyes are soluble in typical coating solvents, yield high density thermal transfer images, and are significantly more light stable than closely related dyes of the prior art.

The invention has been described in detail with particular reference to preferred embodiments thereof, but it will be understood that variations and modifications can be effected within the spirit and scope of the invention.

We claim:

1. A dye donor element for thermal dye transfer comprising a support having thereon a dye in a polymeric binder, said dye being a 4-nitro-pyrazol-5-yl-azoaniline magenta dye having the formula;

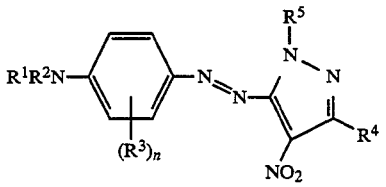

wherein:

$R^1$ is a substituted or unsubstituted alkyl group of 1 to about 12 carbon atoms, a substituted or unsubstituted aryl group of from about 6 to about 10 carbon atoms, substituted or unsubstituted cycloalkyl group of from about 5 to about 7 carbon atoms or substituted or unsubstituted allyl group;

$R^2$ may be H or $R^1$;

$R^1$ and $R^2$ may be joined together to form a 5- or 6-membered ring;

either or both of $R^1$ and $R^2$ may be joined together with one of $R^3$ to form a 1-or 6-membered ring;

$R^3$ may be H, acyloxy, alkoxy, aryloxy, alkylthio, arylthio, alkylsulfonyl, arylsulfonyl, alkylaminosulfonyl, arylaminosulfonyl, alkylsulfonylamino, arylsulfonylamino, thiocyano, cyano, halogen, alkoxycarbonyl, aryloxycarbonyl, acetyl, aroyl, alkylaminocarbonyl, arylaminocarbonyl, alkylaminocarbonyloxy, arylaminocarbonyloxy, acylamino, amino, alkylamino, arylamino, trihalomethyl, alkyl, aryl, hetaryl, alkylureido, arylureido, succinimido or phthalimido;

any two adjacent $R^3$'s may be combined to form a 5- or 6-membered carbo- or heterocyclic saturated or aromatic ring;

n represents an integer from 1–4;

$R^4$ is the same as $R^2$; and $R^5$ is $R^1$, acetyl, aroyl, alkylsulfonyl, arylsulfonyl or substituted or unsubstituted vinyl.

2. The element of claim 1 wherein $R^1$ and $R^2$are each ethyl or propyl, $R^3$ is 3-$NHCOCH_3$, $R^4$ is t-butyl or methyl, and $R^5$ is methyl, phenyl or $CH_2COCH_3$.

3. The element of claim 1 wherein said support comprises poly(ethylene terephthalate) and the side of the support opposite the side having thereon said dye layer is coated with a slipping layer comprising a lubricating material.

4. The element of claim 1 wherein said dye layer comprises repeating areas of yellow, cyan and said magenta dye.

5. A process of forming a dye transfer image comprising imagewise-heating a dye donor element comprising a support having thereon a dye layer comprising a dye dispersed in a polymeric binder and transferring a dye image to a dye-receiving element to form said dye transfer image, wherein said dye is a 4-nitro-pyrazol-5-yl-azoaniline magenta dye having the formula:

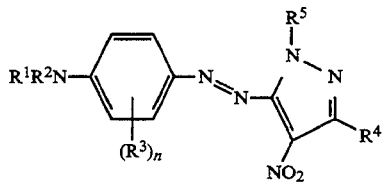

wherein:

$R^1$ is a substituted or unsubstituted alkyl group of 1 to about 12 carbon atoms, substituted or unsubstituted aryl group of from about 6 to about 10 carbon atoms, a substituted or unsubstituted cycloaklyl group of from about 5 to about 7 carbon atoms or a substituted or unsubstituted allyl group;

$R^2$ may be H or $R^1$;

$R^1$ and $R^2$ may be joined together to form a 5- or 6-membered ring;

either or both of $R^1$ and $R^2$ may be joined together with one of $R^3$ to form a 5- or 6-membered ring;

$R^3$ may be H, acyloxy, alkoxy, aryloxy, alkylthio, arylthio, alkylsulfonyl, arylsulfonyl, alkylaminosulfonyl, arylaminosulfonyl, alkylsulfonylamino, arylsulfonylamino, thiocyano, cyano, halogen, alkoxycarbonyl, aryloxycarbonyl, acetyl, aroyl, alkylaminocarbonyl, arylaminocarbonyl, alkylaminocarbonyloxy, arylaminocarbonyloxy, acylamino, amino, alkylamino, arylamino, trihalomethyl, alkyl, aryl, hetaryl, alkylureido, arylureido, succinimido or phthalimido;

any two adjacent $R^3$'s may be combined to form a 5- or 6- membered carbo- or heterocyclic saturated or aromatic ring;

n represents an integer from 1–4;

$R^4$ is the same as $R^2$; and $R^5$ is $R^1$, acetyl, aroyl, alkylsulfonyl, arylsulfonyl or substituted or unsubstituted vinyl.

6. The process of claim 5 wherein $R^1$ and $R^2$are each ethyl or propyl, $R^3$ is 3-$NHCOCH_3$, $R^4$ is t-butyl or methyl, and $R^5$ is methyl, phenyl or $CH_2COCH_3$.

7. The process of claim 5 wherein said support is poly(ethylene terephthalate) which is coated with sequential repeating areas of yellow, cyan and said magenta dye, and said process steps are sequentially performed for each color to obtain a three-color dye transfer image.

8. A thermal dye transfer assemblage comprising:

(a) a dye donor element comprising a support having thereon a dye layer comprising a dye dispersed in a polymeric binder, and (b) a dye-receiving element comprising a support having thereon a dye image-receiving layer, said dye-receiving element being in superposed relationship with said dye-donor element so that said dye layer is in contact with said dye image-receiving layer, wherein said dye is a 4-nitro-pyrazol-5-ylazoaniline magenta dye having the formula:

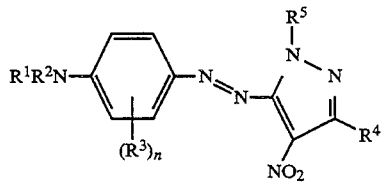

wherein:

$R^1$ is a substituted or unsubstituted alkyl group of 1 to about 12 carbon atoms, substituted or unsubstituted aryl group of from about 6 to about 10 carbon atoms, a substituted or unsubstituted cycloaklyl group of from about 5 to about 7 carbon atoms or a substituted or unsubstituted allyl group;

$R^2$ may be H or $R^1$;

$R^1$ and $R^2$ may be joined together to form a 5- or 6-membered ring;

either or both of $R^1$ and $R^2$ may be joined together with one of $R^3$ to form a 5- or 6-membered ring;

$R^3$ may be H, acyloxy, alkoxy, aryloxy, alkylthio, arylthio, alkylsulfonyl, arylsulfonyl, alkylaminosulfonyl, arylaminosulfonyl, alkylsulfonylamino, arylsulfonylamino, thiocyano, cyano, halogen, alkoxycarbonyl, aryloxycarbonyl, acetyl, aroyl, alkylaminocarbonyl, arylaminocarbonyl, alkylaminocarbonyloxy, arylaminocarbonyloxy, acylamino, amino, alkylamino, arylamino, trihalomethyl, alkyl, aryl, hetaryl, alkylureido, arylureido, succinimido or phthalimido;

any two adjacent $R^3$'s may be combined to form a 5- or 6- membered carbo- or heterocyclic saturated or aromatic ring;

n represents an integer from 1–4;

$R^4$ is the same as $R^2$; and $R^5$ is $R^1$, acetyl, aroyl, alkylsulfonyl, arylsulfonyl or substituted or unsubstituted vinyl.

9. The assemblage of claim 6 wherein $R^1$ and $R^2$ are each ethyl or propyl, $R^3$ is 3-$NHCOCH_3$, $R^4$ is t-butyl or methyl, and $R^5$ is methyl, phenyl or $CH_2COCH_3$.

* * * * *